United States Patent [19]

Gottsegen et al.

[11] 4,351,165

[45] Sep. 28, 1982

[54] PORTABLE COOLER

[76] Inventors: Marten Gottsegen, 1212 Lake Shore Dr., Chicago, Ill. 60610; Fred F. Drucker, 205 Riverside La., Lincolnshire, Ill. 60015; Henry Glass, 245 Dickens Rd., Northfield, Ill. 60093

[21] Appl. No.: 223,121

[22] Filed: Jan. 7, 1981

[51] Int. Cl.[3] ..... F25D 3/08

[52] U.S. Cl. ..... 62/371; 62/457; 220/4 E

[58] Field of Search ..... 62/457, 371, 372, 529, 62/530; 220/4 B, 4 E

[56] References Cited

U.S. PATENT DOCUMENTS

| | | | |
|---|---|---|---|
| 2,652,698 | 9/1953 | Schlumbohm | 62/371 X |
| 2,986,300 | 5/1961 | Parrish | 220/4 E |
| 3,225,983 | 12/1965 | Majka | 62/371 X |
| 3,452,469 | 7/1969 | White | 62/372 X |
| 3,482,418 | 12/1969 | Moore | 62/457 |
| 4,024,731 | 5/1977 | Branscum | 62/457 |
| 4,050,264 | 9/1977 | Tanaka | 62/457 |
| 4,213,310 | 7/1980 | Buss | 62/457 |
| 4,238,934 | 12/1980 | Hotta | 62/457 |
| 4,281,520 | 8/1981 | Norwood | 62/372 |
| 4,287,943 | 9/1981 | Hotta | 62/457 |

FOREIGN PATENT DOCUMENTS

| | | | |
|---|---|---|---|
| 209569 | 7/1957 | Australia | 62/457 |
| 1167298 | 11/1958 | France | 62/457 |
| 590969 | 4/1959 | Italy | 62/457 |

*Primary Examiner*—Lloyd L. King

*Attorney, Agent, or Firm*—Jacques M. Dulin

[57] ABSTRACT

A cooler having a removable coolant receptacle secured between and dividing a pair of insulated containers attached together by a hinge. The coolant receptacle closes the openings of the two containers and divides the cooler into separate compartments. The coolant receptacle extends partially into both compartments and thus provides lateral support to the cooler when their openings are closed against each other. A carrying strap is attached at its ends to one of the containers and is also releasably attachable to the other container to hold the containers together in a closed position. Another strap securing the coolant receptacle to the other container is secured to the other container by the releasable attachment means for the carrying strap. Each container has an outer shell and an inner insulation shell held within the outer shell by an inwardly extending lip at the periphery of the outer shell opening.

10 Claims, 7 Drawing Figures

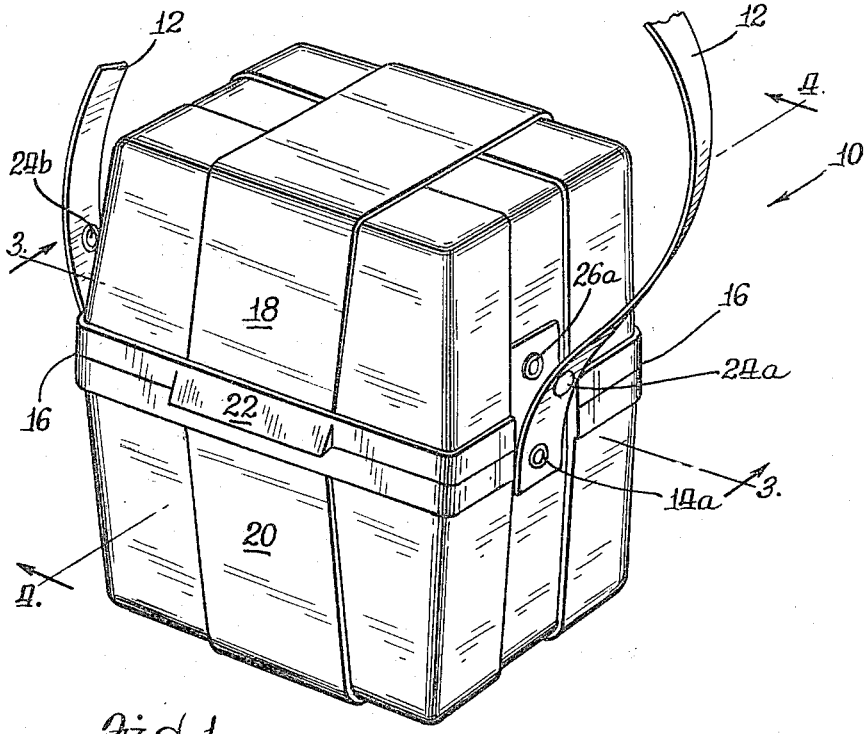
Fig. 1.
Fig. 2.
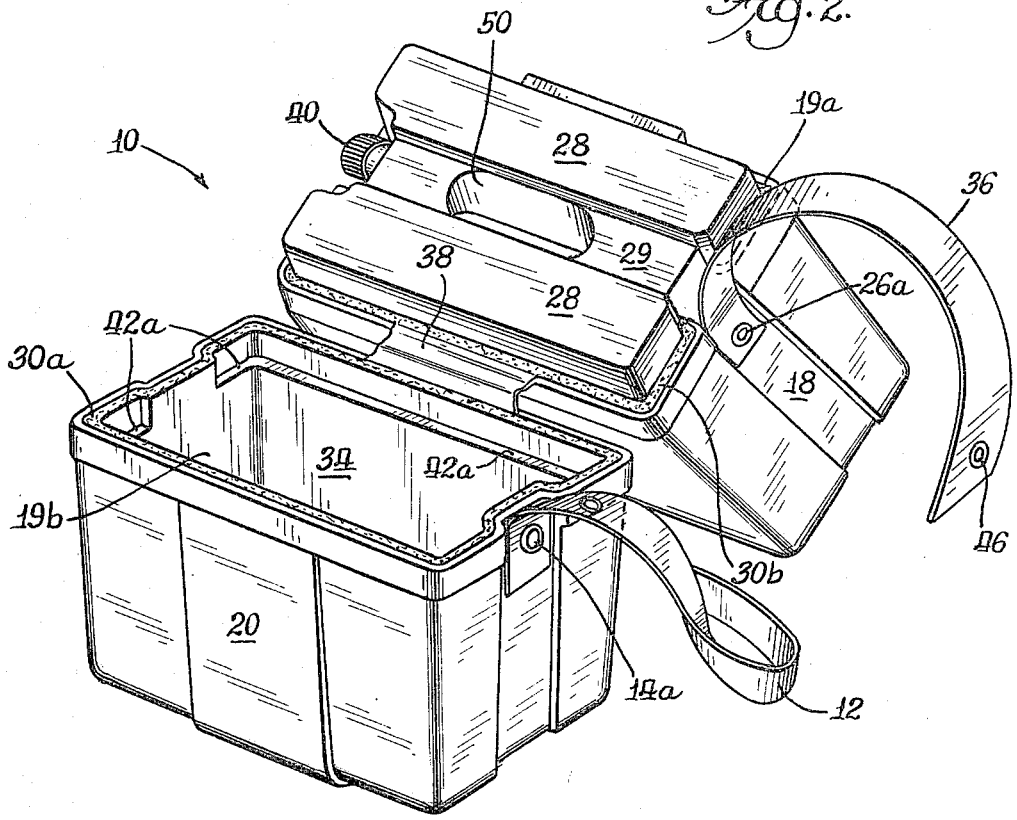

Fig. 3.
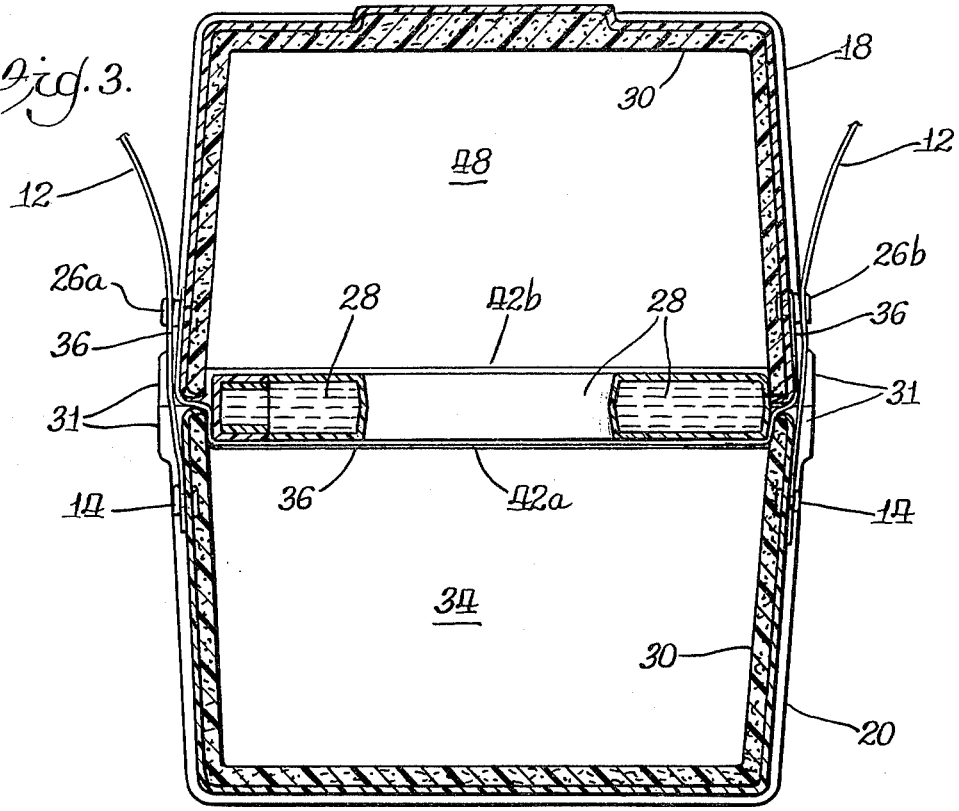
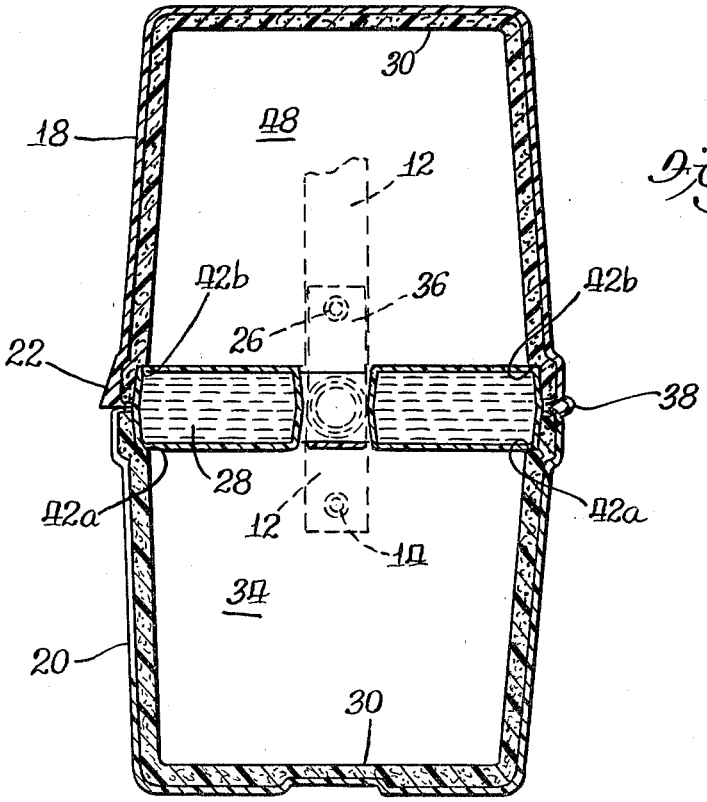
Fig. 4.

PORTABLE COOLER

BACKGROUND OF THE INVENTION

This invention relates to the field of portable, thermally insulated coolers for general and recreational use and, more particularly to such a cooler which contains a receptacle for frozen coolant.

Traditional cooler chests have been large and cumbersome and adapted to carry ice in the same compartment as the contents to be kept cool. However, there have also been provided coolers with a self-contained, removable cooling unit and smaller, lightweight coolers to fit the needs of only one or two people. Examples of these are found in U.S. Pat. Nos. 3,255,607; 1,998,681; 3,406,532; 4,024,731, and 3,678,703, and in German Pat. No. 946,813.

All of these patents except U.S. Pat. No. 3,255,607 to Bair et al. show the cooling unit for use in cooling and no other purpose. Bair et al., on the other hand, teach the use of a removable cooling unit which also acts as a shelf and storage tray. Unfortunately, the lower compartment in Bair et al may conveniently be reached only by removing the objects in the cooling unit and then the unit itself. Also, the cooling unit rests on a small ledge and is not secured to the cooler. Like many known coolers the Bair et al. cooler has a carrying handle but may not be carried hands free.

SUMMARY OF THE INVENTION

In accordance with the present invention, a receptacle for liquid, such as coolant, is releasably mounted between and divides first and second insulated containers at their openings when the first container opening is closed against the second container opening.

One of the features of the invention is that the two containers are hinged together and are of substantially equal dimension to be substantially equally supported by a horizontal surface when fully opened.

A further feature is that the receptacle is substantially coextensive with the openings of the insulated containers and has an opening therethrough to facilitate manual removal. Thus the receptacle functions as a removable cover for one of the containers when the two containers are in their open position.

Another advantageous feature is that a strap releasably secures the receptacle to one of the containers. The strap rests in a groove and overlies the opening.

Yet another advantageous feature is the provision of an elongate carrying strap attached at opposite ends to one of the containers and having means spaced from the ends for releasably securing the strap to opposite ends of the other container when the openings of the first and second containers are closed against one another to hold the containers together.

The releasable securing means performs the additional function of releasably attaching one end of the receptacle securing strap to the other container.

The containers each comprise an outer container with an opening, and an inner container of thermal insulating material substantially conforming to the size and shape of the interior of the outer containers and inserted therein. A flexible lip is mounted to the outer container at the periphery of the opening thereof and projects inwardly to overlay at least a portion of the inner container for holding it to the outer container.

BRIEF DESCRIPTION OF THE DRAWINGS

The foregoing features and advantages will be explained in greater detail and further features and advantages will be made apparent from the following description of the preferred embodiment given with reference to the several views of the drawings, in which:

FIG. 1 is a perspective view of the cooler showing it in a closed position;

FIG. 2 is a perspective view of the cooler in a partially open position with the coolant receptacle mounted in the upper container;

FIG. 3 is a sectional view of the cooler taken along section line 3—3 of FIG. 1;

FIG. 4 is a sectional view taken along section line 4–4 of FIG. 1;

DESCRIPTION OF THE PREFERRED EMBODIMENT

Figure 5:
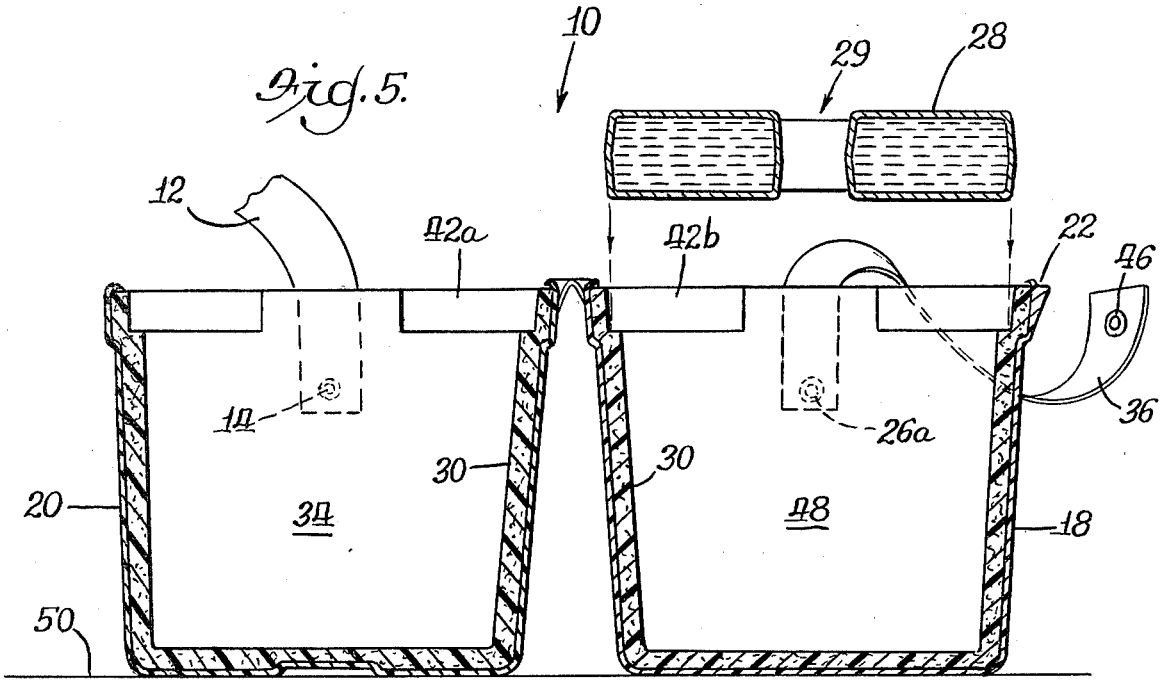
FIG. 5 is a sectional end view showing the chest fully opened and the coolant receptacle removed for access to the upper container.

Referring first to FIG. 1, our cooler chest, or cooler, 10 is seen to have an upper outer shell 18 and a lower outer shell, or container, 20 joined together substantially at midpoint along a seam 16. A shoulder strap 12 is secured to the lower container 20 to enable hands-free carrying of the cooler.

As best seen in FIG. 3, shoulder strap 12 is fixedly attached at opposite ends thereof to opposite sides of lower container 20 by rivets **14*a* and 14*b*, respectively. Shoulder strap 12 also carries female snap connectors 24*a* and 24*b* spaced a short distance from rivets 14*a* and 14*b*, respectively. These female connectors 24*a* and 24*b* releasably connected with mating male snap connectors 26*a* and 26*b* mounted to upper container 18. When the mating snap connectors are connected together, the portion of strap 12 between the connectors and the adjacent rivets 14*a* or 14*b* secures the upper shell 18 to the lower shell 20 in a closed position, as shown in FIG. 1**.

Referring now to FIG. 2, cooler 10 is shown in a partially opened position. It is seen that upper shell 18 contains a freezer bottle, or coolant receptacle, 28 which snugly fits inside of and substantially closes an opening **19*a* of upper shell 18. The freezer bottle 28 is provided for containing a frozen liquid, such as ice, to keep the contents of the chest 10 at a reduced temperature. However, freezer bottle 28 has a removable cap 40** which allows for the insertion and drainage of the freezable liquid and, thus, may also serve to contain a beverage.

The freezer bottle 28 is held in place with flexible freezer strap 36 which has one end fixedly attached by male snap connector **26*a* to the upper shell 18. The other end of freezer strap 36 has an opening 46 which snugly fits over male snap connector 26*b*, shown in FIG. 3**.

Thus, when female snap connector **24*b* is connected to male snap connector 26*b*, the connection performs the additional function of securing the other end of freezer strap 36 to the upper shell 20 to secure freezer bottle 36 thereto. A groove 29 is provided in bottle 28 to receive a freezer strap 36 and to hold it against lateral movement for securing the freezer bottle to the upper outer shell 20**.

Also helping to maintain a reduced temperature are a pair of insulated walls 30*a* and 30*b* molded to fit snugly inside of and adjacent upper outer shell 18 and lower outer shell 20, respectively. The insulation walls 30*a* and 30*b* are made from suitable insulation material such as foamed styrene and are held in place by lips 31, FIG. 3, which curl inwardly and overlie the top edges of insulation walls 30*a* and 30*b*. The outer walls of the shells 18 and 20 are preferably formed of a more rigid plastic.

As best seen in FIGS. 2, 4 and 5, a hinge 38 connects upper outer shell 18 to lower outer shell 20. When fully opened, upper shell 18 pivots about hinge 38 such that it will rest on the same surface 50 as lower shell 20, as shown in FIG. 5. Referring to FIG. 4, insulation walls 30*a* and 30*b* are provided with a ledge 42*a* and 42*b*, respectively, extending around most of the perimeter of openings 19*a* and 19*b*, respectively. When an upper outer shell 18 is closed over lower outer shell 20 the freezer bottle is securely held between the two ledges 42*a* and 42*b*. FIGS. 1, 2 and 4 also illustrate shoulder 22 in the upper outer shell 18 which functions as a finger-hold to permit lifting upper shell 18 which rotates on its hinge 38 to open.

Advantageously, the freezer bottle 28 functions also as a closure for the upper outer shell 18 of chest 10 even when the chest 10 is in its open position, as shown in FIG. 5, for instance. Further, it should be noted that the weight of the freezer bottle 28 and the food supported by bottle 28 tend to keep the upper outer shell 18 pressed closed upon lower outer shell 20 while chest is in transit or otherwise in its normal upright position, as shown in FIG. 1.

Again referring to FIGS. 3 and 4, chest 10 is shown in sectional views illustrating the mating engagement between the freezer bottle 28 and insulation wall 30 when the chest is fully closed. Freezer bottle 28 is shown held in place by strap 36 which is connected at both its ends to male connector snaps 26*a* and 26*b* on upper outer shell 18 of chest 10. Strap 36 is permanently connected at male connector snap 26*a* and has opening 46 slip-fitted over the other male connector snap 26*b*. The flat freezer bottle 28 divides cooler 10 into two food compartments 34 and 48 of substantially equal size. Also, since the freezer bottle 28 is disposed substantially midway in the inner space of cooler 10, there is a more centralized distribution of the heat sink effects of freezer bottle 28 to the food items over that which would be obtained in a chest having ice or the like at either the top or the bottom of the chest 10.

Referring now to FIG. 5, chest 10 is shown in its fully open position with outer shells 18 and 20 resting equally on surface 50. In its fully opened position chest 10 forms two inner compartments 34 and 48 joined together by hinge 38. Freezer bottle 28 is shown elevated from upper shell 18 to illustrate its removability and its positioning with respect to the inner compartments 34 and 48. Insulation walls 30 completely cover the inner surfaces of both outer shells 18 and 20.

Figure 6:
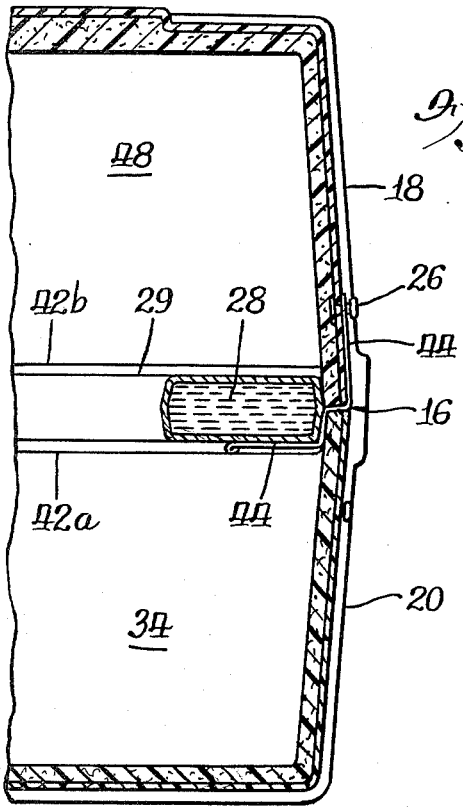
FIG. 6 is a sectional view of part of another embodiment illustrating another means for securing the coolant receptacle to one of the containers.
Figure 7:
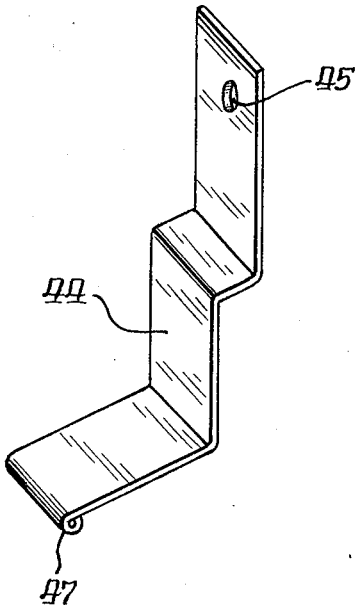
FIG. 7 is a perspective view of the clamp shown in section in FIG. 6.

FIG. 6 illustrates an alternative means for securing freezer bottle 28 to cover inner compartment 48 by means of a pair of freezer clamps 44 shown in FIG. 7. The clamps 44 are secured by male connector snaps 26*a* and 26*b* to upper shell 18 through an opening 45 in the side walls thereof. Clamps 44 extend through seam 16 of chest 10 to fit in groove 29 of freezer bottle 28 such that freezer bottle 28 is held against ledge 42*a*. The clamp of FIG. 7 is made of resilient material, and to release freezer bottle 28, rolled ends 47 of clamps 44 are pivotted away from the bottle 28 as it is removed. An opening 50 through the bottle 28, as best seen in FIG. 2, functions as a handle opening to facilitate removal of the bottle 28.

While a specific embodiment has been disclosed it should be appreciated that many variations may be made without departing from the scope of the invention. For instance, although the term cooler and coolant has been used throughout, it should be understood that the cooler 10 can also be used to keep the contents warm and in that event the "coolant" should be a hot liquid.

Further, although the preferred embodiment has been described as being of a size suitable for one person to carry by means of the shoulder strap, many of the features can also be advantageously employed with a larger cooler.

Also, while the two containers 18 and 20 are preferably fixedly hinged together, it is contemplated that in some instances it may be more versatile to have them completely separable. Further, the shoulder strap may be releasably rather than fixedly attached to the lower container 20 in which case the upper container 18 may function as an independent unit. In that event the coolant receptacle will function as the sole closure. The snap connector attaching the shoulder strap to the upper container would still function to attach the receptacle securing strap to the upper container 18.

We claim:

1. A portable cooler, comprising in operative combination:

(a) a first, lower insulated container having an outer shell and an inner liner of insulating material, which container consists essentially of four adjoining walls and an integral base defining a volume for carrying items, and being substantially open on a sixth side;

(b) a second, upper insulated container having an outer shell and an inner liner of insulating material, which container consists essentially of four adjoining walls and an integral top defining a volume for carrying items, and being substantially open on a sixth side;

(c) a removable closure for said openings of said containers comprising a liquid container substantially coextensive with said openings;

(d) said insulated liner walls of both said insulated containers having a shoulder defined adjacent said open sixth side to receivingly engage said liquid container, said liquid container forming a closure for either of said insulated containers;

(e) said liquid container extends partially into the volume of each of said insulated containers and defines a separator between said two insulated containers when said insulated containers are inverted on each other with said liquid container therebetween to form a combined container having at least two substantially separate volumes for items, and said first insulated container forming the lower portion and said second container forming said upper portion when said containers are in the closed position;

(f) said liquid container providing an interlock of said two insulated container portions against relative lateral movement and providing lateral support;

(g) means for releasably securing said liquid container to said second, upper insulated container; and (h) a carrying strap secured adjacent opposite ends thereof to opposite sides of said first, lower insulated container shell, and having means spaced from the secured ends for releasably attaching the strap to corresponding opposite sides of the second, upper insulated container shell, whereby the portions of the strap between the ends and said reeasably attaching means hold the first and second insulated containers together.

2. A cooler as in claim 1 wherein a first of said releasably attaching means for said carrying straps also serves to releasably attach said liquid container securing means.

3. A cooler as in claim 2 in which said liquid container has an elongate groove, and said liquid container securing means is received in said groove when securing the liquid container to said upper insulated container.

4. A cooler as in claim 3 in which said liquid container releasably securing means comprises a strap overlying said liquid container, and one end of said strap is fixedly secured to a first side of the upper insulated container shell, and the other end is releasably attached to said carrying strap first releasably securing means.

5. A cooler as in claim 4 in which said carrying handle releasably securing means are snap connectors.

6. A cooler as in claim 1 in which said liquid container releasably securing means comprises at least one resilient clamp attached to the top insulated container shell and releasably engaging said liquid container.

7. A cooler as in claim 1 including a hinge for pivotally securing the first lower and second upper insulated container shells together and in which said insulated containers are of substantially equal dimension so that when opened both insulated containers will be substantially equally supported by a horizontal surface.

8. A cooler as in claim 7 which includes a flexible lip integrally formed in the shell of the insulated containers at the periphery of the open side thereof and projecting inwardly to overlay and engage at least a portion of the inner insulating liner to retain it within the outer container shell.

9. A cooler as in claim 7 which includes a shoulder integrally formed in the shell of the upper insulated container at the periphery thereof adapted to permit engagement by hand to lift said upper container from said lower container.

10. A cooler as in claim 1 wherein said liquid container has an elongated aperture therethrough to permit removal thereof by hand from said shoulders in said insulated walls.

* * * * *